US011576498B1

(12) United States Patent
Stern

(10) Patent No.: US 11,576,498 B1
(45) Date of Patent: Feb. 14, 2023

(54) APPARATUS FOR PREVENTING SLIPPAGE OF STACKED OBJECTS

(71) Applicant: Thomas Stern, Brooklyn, NY (US)

(72) Inventor: Thomas Stern, Brooklyn, NY (US)

( * ) Notice: Subject to any disclaimer, the term of this patent is extended or adjusted under 35 U.S.C. 154(b) by 608 days.

(21) Appl. No.: 15/456,162

(22) Filed: Mar. 10, 2017

Related U.S. Application Data

(60) Provisional application No. 62/389,935, filed on Mar. 14, 2016.

(51) Int. Cl.
*A47C 21/02* (2006.01)

(52) U.S. Cl.
CPC ..... *A47C 21/026* (2013.01)

(58) Field of Classification Search
CPC ..... A47C 21/026
See application file for complete search history.

(56) References Cited

U.S. PATENT DOCUMENTS 668,884 A * 2/1901 Romaine ..... A47C 21/026 5/411
1,031,656 A * 7/1912 Romaine ..... A47C 21/026 5/193
1,090,875 A * 3/1914 Poland ..... A47C 21/026 5/193
1,125,277 A * 1/1915 Eckerson ..... A47C 21/026 5/193
1,231,469 A * 6/1917 Anderson ..... A47C 21/026 5/136
1,336,003 A * 4/1920 Demark ..... A47C 21/026 5/193
1,371,098 A * 3/1921 Jones ..... A47C 21/026 5/193
1,384,600 A * 7/1921 Spohrer ..... A47C 21/026 5/411
1,559,119 A * 10/1925 Miller ..... A47C 21/026 5/411
1,577,089 A * 3/1926 Whitford ..... A47C 21/024 5/505.1
1,810,601 A * 6/1931 Goldberg ..... A47C 21/026 5/193
1,842,873 A * 1/1932 Leeking ..... A47C 21/026 5/411
2,024,050 A * 12/1935 May ..... A47C 21/022 24/72.5

(Continued)

*Primary Examiner* — David R Hare
(74) *Attorney, Agent, or Firm* — Brian Roffe

(57) ABSTRACT

Stacked object slippage prevention apparatus includes two rigid retainers each having a straight portion and an angled portion at an angle of 80-115 degrees to the straight portion, and a connecting element connected at opposite end regions to the retainers. The connecting element may be a strap and a pair of fixing elements, one at each end region of the strap, and which are adjustable relative to the strap to provide the strap with an adjustable length to fit different sized beds. When installed, for example, between a mattress and an underlying support, with the angled portion of the retainer at the foot of the bed oriented upward and the angled portion of the retainer at the head of the bed oriented downward, movement of the mattress toward the foot of the bed is prevented by pressure applied to the support being transferred between the retainers through the connecting element.

19 Claims, 7 Drawing Sheets

(56) References Cited

U.S. PATENT DOCUMENTS 2,147,538 A * 2/1939 MaGuire ..... A47C 21/026 5/411
2,154,557 A * 4/1939 Bechik ..... A47C 21/026 5/411
2,257,554 A * 9/1941 Hitchcock ..... A47C 21/026 5/411
2,666,931 A * 1/1954 Clerc ..... A47C 19/04 248/188.91
2,701,884 A * 2/1955 Young ..... A47C 21/026 5/411
3,350,726 A * 11/1967 Gardner ..... A47C 21/026 5/411
3,520,030 A * 7/1970 Hawkins ..... A47C 21/026 24/72.5
3,999,231 A * 12/1976 Robins ..... A47C 19/005 5/176.1
4,017,919 A * 4/1977 Hemmeter ..... A47C 21/026 5/411
4,104,751 A * 8/1978 Churchman ..... A47C 21/00 5/503.1
4,199,831 A * 4/1980 Muller ..... A47C 21/022 5/411
4,297,754 A * 11/1981 Zuniga ..... A47C 21/026 5/411
4,458,371 A * 7/1984 Whitehead ..... A47C 19/025 5/200.1
4,466,148 A * 8/1984 Jones ..... A47C 21/00 108/55.1
4,539,723 A * 9/1985 Hillsberry ..... A47C 27/085 24/72.5
4,899,404 A * 2/1990 Galumbeck ..... A47C 20/04 16/366
5,148,560 A * 9/1992 Torres ..... A47C 21/022 24/72.5
5,221,273 A * 6/1993 Graham ..... A47C 27/005 5/484
5,325,554 A * 7/1994 Lewis ..... A47C 21/022 5/496
5,377,391 A * 1/1995 Foster ..... A47C 21/022 24/301
5,404,602 A * 4/1995 Kondo ..... A47C 21/022 24/499
5,467,491 A * 11/1995 Griffith ..... A47C 21/022 24/72.5
5,621,931 A * 4/1997 Hamilton ..... A47G 9/0292 5/482
D379,283 S * 5/1997 Antinori ..... 5/411
5,640,726 A * 6/1997 Fichner-Rathus ..... A47C 21/08 5/426
5,737,783 A * 4/1998 Antinori ..... A47C 20/04 248/300
5,815,861 A * 10/1998 LaGrange ..... A47C 21/022 5/504.1
6,035,467 A * 3/2000 Lee ..... A47C 17/70 5/174
6,108,837 A * 8/2000 Knebel, III ..... A47C 21/022 24/457
6,295,670 B1 * 10/2001 Schieberl ..... A47C 21/022 24/72.5
6,611,977 B1 * 9/2003 Schuman ..... A47C 19/021 29/897
6,684,425 B2 2/2004 Davis
6,889,396 B2 * 5/2005 Weinman ..... A47C 21/026 5/411
7,036,170 B2 * 5/2006 Antinori ..... A47C 21/026 5/411
7,373,679 B2 * 5/2008 Miller ..... A47C 21/08 5/426
7,607,181 B1 * 10/2009 Harrison ..... A47C 21/026 5/411
8,646,130 B2 * 2/2014 Alzoubi ..... A47C 21/026 5/193
9,044,365 B2 * 6/2015 Rawls-Meehan ..... A61G 7/015
9,204,742 B2 * 12/2015 Jensen ..... A47G 9/0238
9,962,006 B2 * 5/2018 Shih ..... A47C 19/021
9,986,844 B2 * 6/2018 Shih ..... A47C 21/026
2003/0150058 A1 * 8/2003 Davis ..... A47C 20/048 5/615
2004/0060113 A1 * 4/2004 Lantagne ..... A47C 21/022 5/494
2005/0210587 A1 * 9/2005 Piana ..... A47C 21/026 5/618
2008/0134431 A1 * 6/2008 Piana ..... A47C 21/026 5/411
2013/0185868 A1 * 7/2013 Rohr ..... A47C 21/026 5/498
2016/0367043 A1 * 12/2016 Scarleski ..... A47C 21/00
2019/0029437 A1 * 1/2019 Sokvitne ..... A47C 21/00

* cited by examiner

FIG. 1
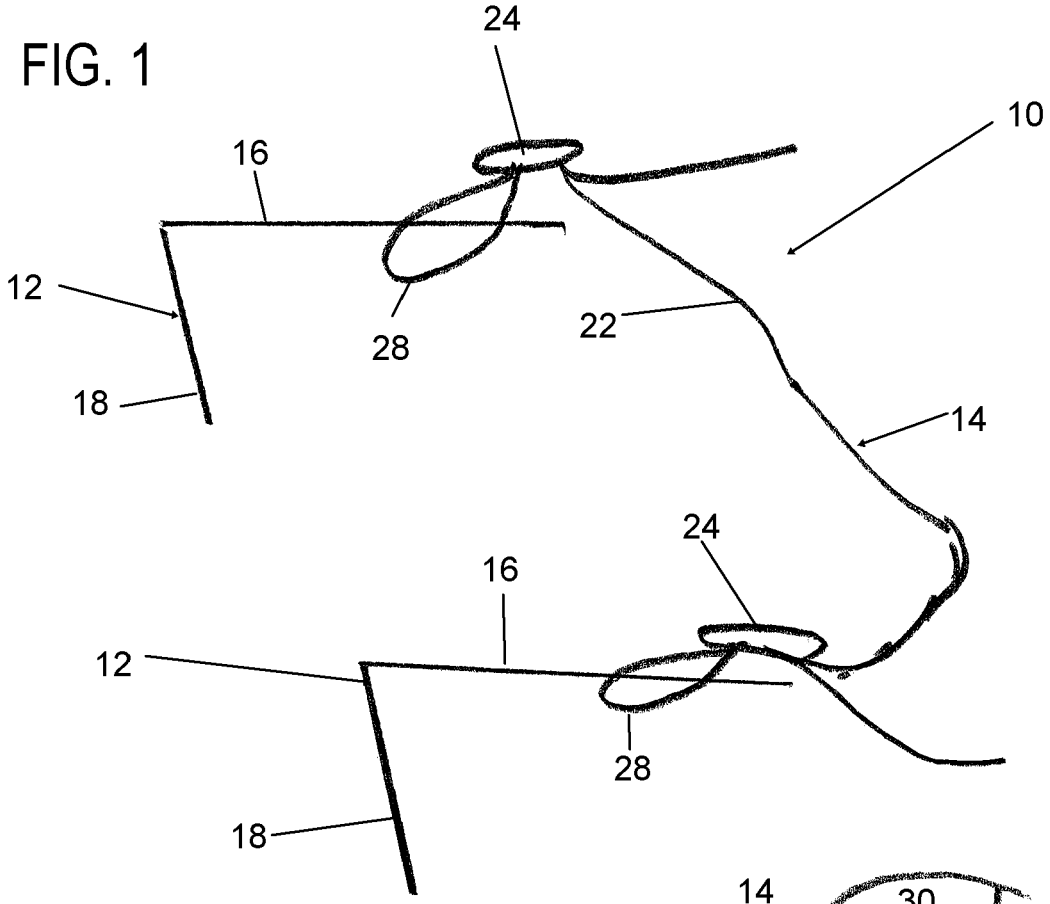
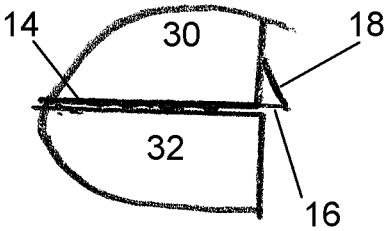
FIG. 3
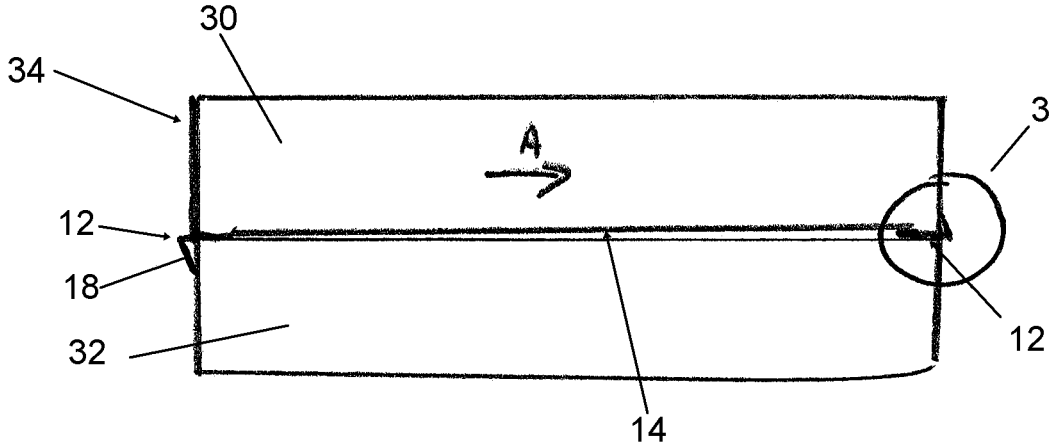
FIG. 2

APPARATUS FOR PREVENTING SLIPPAGE OF STACKED OBJECTS

CROSS-REFERENCE TO RELATED APPLICATION

This application claims priority of U.S. provisional patent application Ser. No. 62/389,935, filed Mar. 14, 2016, which is incorporated by reference herein.

FIELD OF THE INVENTION

The present invention relates generally to apparatus and methods for preventing slippage of stacked objects, and more specifically to apparatus for preventing slippage of a mattress relative to its underlying support, typically a boxspring, and methods for preventing slippage of a mattress.

BACKGROUND OF THE INVENTION

Conventional beds often include a boxspring and a mattress on top of the boxspring. A boxspring is representative of a support structure that is used to support the mattress and may be referred to by other terms. As used herein, a boxspring will therefore mean any type of mattress support which is placed underneath the mattress to support it. There is typically no structure that connects the mattress to the boxspring. Lacking such structure, often the mattress slips relative to the boxspring.

In some instances, when the mattress is a relatively light mattress, the mattress tends to shift as a person moves around on their bed.

Slippage is also compounded if someone uses an under-mattress wedge, or raises the head of the bed in any manner, in order to raise the head of the person using the mattress. This angular inclination or orientation of the bed (including both the mattress and boxspring) puts a downward force on the mattress, i.e., in a direction toward the foot of the bed, and as a result, the mattress tends to slide down over the boxspring.

Similar issues of slippage arise in connection with other stacked objects, such as stacked boxes and the like. Often, it is possible for an upper stacked object to move relative to the lower stacked object and create instability of the stacked objects. This movement may be created naturally, or by external forces, such as may occur during an earthquake. The resulting instability may result in the uppermost stacked object falling down.

SUMMARY OF THE INVENTION

An object of the present invention is to provide apparatus and methods for preventing slippage of stacked objects, and more specifically to provide apparatus and methods for preventing slippage of a mattress relative to its underlying support.

A slippage prevention apparatus for preventing slippage of an upper stacked object relative to an immediately underlying lower stacked object in accordance with the invention includes a first rigid retainer having a first straight portion and a second angled portion at an angle of about 80 degrees to about 115 degrees to the first portion, a second rigid retainer, and a connecting element connected at one end region to the first retainer and at an opposite end region to the second retainer. The second retainer may be like the first, i.e., with a first straight portion and a second angled portion at an angle of about 80 degrees to about 115 degrees to the first portion.

In one embodiment, the apparatus is used in combination with a bracket attachable to a support and that includes side flanges and a middle portion in a different plane than the side flanges. Alternatively, the second retainer may comprise such a bracket. A bracket attachment mechanism attaches the side flanges of the bracket to the support. The angled portion of the second retainer is configured to slide behind the middle portion of the bracket to secure the second retainer to the bracket and thus to the support when the bracket is attached to the support.

In some embodiments, the connecting element includes an elongate strap and a pair of fixing elements, one at each end region of the strap and which are adjustable relative to the strap to provide the strap with an adjustable length. For example, each fixing elements may have two slots sized to allow the strap to pass therethrough, each end of the strap being looped through the two slots in a respective fixing element to form a loop into which a portion of a respective retainers is situated. Instead of fixing elements, the connecting element may include a component at one end region of the strap that is fixed or removably connected to the first retainer and another component at an opposite end region of the strap that is fixed or connected to the second retainer. An attachment mechanism may connect each component to its retainer. Instead of a strap, the connecting element may comprise an elongate, rigid bar which may have a single, fixed length or be made of multiple parts and adjustable. In the latter case, a locking mechanism is provided to lock the bar at a desired length.

One configuration of a retainer also includes a third angled portion at an angle of about 80 degrees to about 115 degrees to the first portion and angled in an opposite direction away from the first portion than the second portion is angled away from the first portion.

In another embodiment, one or both retainers includes a base and a pivot member pivotally mounted to the base. The pivot member includes a straight portion and an angled portion that constitutes the angled portion of the retainer. The pivot member pivots relative to the base such that when the straight portion of the pivot member is in a common plane with the base (when the stacked object over the retainer exerts weight against the straight portion), the angled portion of pivot member extends upward.

A method for preventing slippage of an upper stacked object relative to an immediately underlying lower stacked object in accordance with the invention includes placing one retainer as described above at one end of the upper stacked object such that the first portion is between the upper stacked object and the lower stacked object and the second portion is oriented upward and an edge of the upper stacked object rests against the second portion, and placing another retainer at an opposite end of the upper stacked object such that the first portion is between the upper stacked object and the lower stacked object and the second portion is oriented downward and an edge of the lower stacked object rests against the second portion. The retainers are connected together tightly such that force exerted by the upper stacked object against the second portion of the first retainer is exerted against the lower stacked object by the second portion of the second retainer and thereby movement of the upper stacked object in a direction toward the second portion of the first retainer is prevented. This connection may be in any of the ways described above.

Another method for preventing slippage of an upper stacked object relative to an immediately underlying lower stacked object in accordance with the invention includes placing one apparatus longitudinally between the upper stacked object and the lower stacked object, which apparatus may be placed as described above, and placing another apparatus transversely between the upper stacked object and the lower stacked object in a direction perpendicular to the orientation of the first apparatus.

BRIEF DESCRIPTION OF THE DRAWINGS

The following drawings are illustrative of embodiments of the system developed or adapted using the teachings of at least one of the inventions disclosed herein and are not meant to limit the scope of the invention as encompassed by the claims.

FIG. 1 is a side view of an apparatus for preventing slippage of an upper stacked objected relative to an immediately underlying lower stacked object in the same stack in accordance with the invention;

FIG. 2 is a side view show an exemplifying, non-limiting use of the apparatus in accordance with the invention;

FIG. 3 is an enlarged view of the portion designated 3 in FIG. 2;

DETAILED DESCRIPTION OF THE INVENTION

Figure 4:
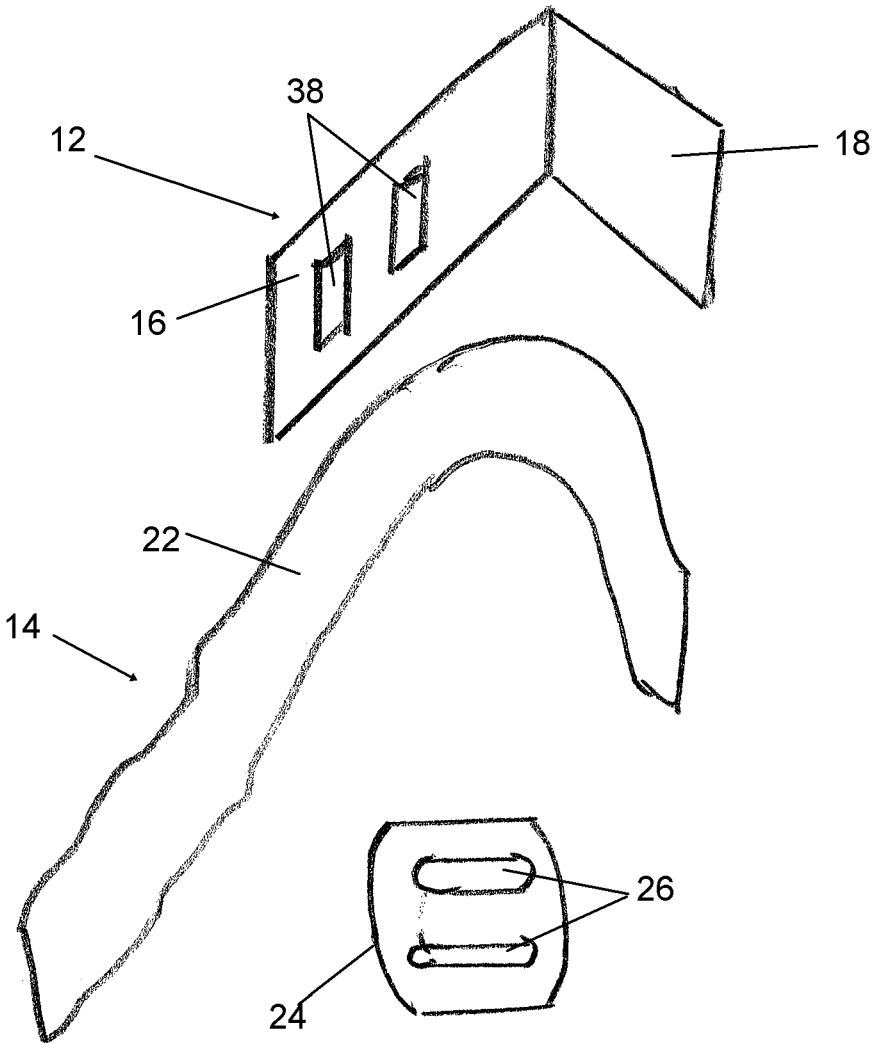
FIG. 4 is a view showing the elements of the apparatus in accordance with the invention.

Referring to the accompanying drawings wherein the same reference numbers refer to the same or similar elements. FIG. 1 shows an apparatus in accordance with the invention which is designated generally as 10 and includes two retaining or retention clips or retainers 12 attached by a connecting element 14. Each retainer 12 is a substantially rigid structure having a first straight portion 16 and a second angled portion 18 at an angle of about 80 degrees to about 115 degrees, preferably about 85-90 degrees, to provide the retainers 12 with a substantially L-shape. In a preferred embodiment, the angle between the first and second portions 16, 18 is about 90 degrees to enable operative use of the apparatus 10 for basic mattress slippage prevention. The retainers 12 may be made of plastic, metal or another suitable material.

The straight portion 16 should have a length of about 2 to about 6 inches and a width of about 2 inches to about 6 inches while the angled portion 18 has a length of about 2 to about 6 inches and a width of about 2 inches to about 6 inches. The length and width of each of the straight portion 16 and angled portion 18 may be different. The size is selected, in consideration of the material from which the straight portion 16 and angled portion 18 are made, to provide adequate rigidity to prevent breakage when pressure is exerted urging movement of the angled portion 18 outward from the straight portion 16. One limitation on the length of the angled portion 18 is that it is not desired that the angled portion 18 interfere with use of the mattress so it should have a length less than the height of the mattress, for example, at least 1-2 inches less than the height of the mattress.

In the illustrated embodiment, connecting element 14 comprises a strap 22 and a pair of fixing elements 24, one at each end region of the strap 22. The fixing elements 24 each have a pair of slots 26 sized to allow the strap 22 to pass therethrough (see FIG. 4). Each end of the strap 22 is looped through two slots 26 in a respective one of the fixing elements 24 in a manner known to those skilled in the art to form a loop 28 into which a portion of a respective retainer 12 is situated (see FIGS. 1 and 4). For example, an end of the strap 14 may be guided through a first one of the slots 26 in the fixing element 24, then over a surface of the fixing element 24 into and through a second one of the slots 26, then into one of a pair of slots 38 in the straight portion 16 of the retainer 12, over a portion of the surface of the retainer 12 between the slots 38, then into and through the other slot 38, then back into the second slot 26 over a portion of the fixing element 24 between the slots 26 and then into the first slot 26. By pulling the end of the strap 22, the strap 22 is tightly held in connection with the fixing element 24. The other end of the strap 22 is similarly secured to the other fixing element 24. In this manner, the retainers 12 are secured to one another by virtue of having a portion of each in the loops formed by the strap 22. In some instances, the fixing element 24 may include more than two slots 26 and a similar manner for threading the strap 22 securely into the fixing element 24 to form the loop 28 is used.

Moreover, the fixing elements 24 enable adjustability in the length of the strap 22 between the retainers 12. This is important because it allows the apparatus 10 to be used for different sized mattress. Strap 22 should preferably have a length at least slightly larger than the length of conventional beds.

Instead of a strap 22 and fixing elements 24, the connecting element 14 may comprise other similar structures that both connect to two structures and also preferably enable a length between the structures to be adjustable. Ideally, the adjustment should be easy, and at a minimum is only required at one end of the strap 22. In one embodiment, the retainers 12 do not include slots 38 and the strap 22 attaches in a permanent manner to the body of the retainers 12. A different adjustment component may be provided to this strap. All such structure and techniques will be considered to constitute attachment means for attaching the fixing elements 24 to the retainers 12.

Other constructions of the connecting element 14 and its attachment to the retainers 12 are also envisioned. For example, it is possible to construct the connecting element 14 to attach to the retainers 12 by sewing, using snaps, using clips, using fasteners, using rivets, using adhesive, and all such attachment techniques are encompassed within the scope of the invention. Attachment means herein will therefore mean any and all such structure and material that serves to attach one component to another, e.g., the strap 22 to the retainer 12, with this attachment being either a permanent attachment (one that is fixed and not adjustable) or a temporary attachment (one that can be changed).

Figure 5:
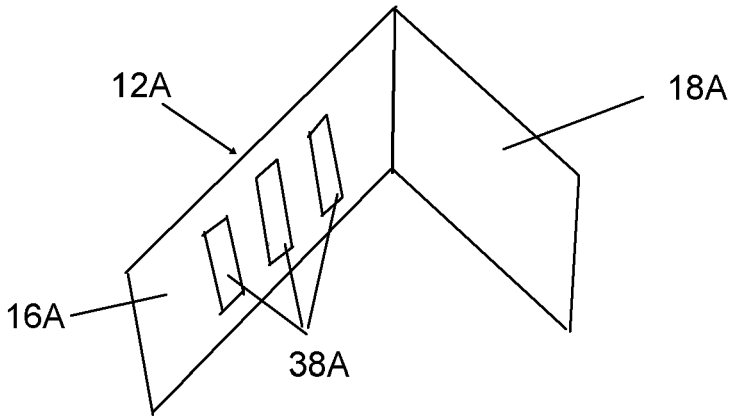
FIG. 5 is a perspective view of a retainer in an alternative embodiment of an apparatus in accordance with the invention.

As an example of an alternate attachment structure, FIG. 5 shows a retainer 12A with three slots 38 on the straight portion 16A and none on the angled portion 18A. With three slots 38, it possible to avoid use of the fixing elements 24, i.e., the strap 22 is passed into and/or through the three slots 38 in a specific manner to secure the strap 22 to the retainer 12A. An apparatus in accordance with the invention can therefore include two retainers 12A and a strap 22, without any fixing elements 24. One or more fixing elements 24 may be used however, for example, if easier adjustment of the strap 22 relative to one or both retainers 12A is desired. The straight portion 16A could also include more than three slots 38 if desired.

FIG. 2 shows one manner in which the apparatus 10 is preferably used. One retainer 12 is placed at one end of the mattress 30 with the first portion 16 between the mattress 30 and the boxspring 32 and the second portion 18 bearing against the mattress 30 (see FIG. 3). This end is that end at which the person sleeping on the mattress 30 places their feet since it will be assumed that slippage of the mattress 30 is in the direction toward the person's feet. The strap 22 and fixing elements 24 are adjusted to provide the strap 22 with a position in which the retainer 12 at the opposite end of the apparatus is positioned such that the first portion 16 is between the mattress 30 and the boxspring 32 and the second portion 18 bears against the boxspring 32, and the strap 22 is tight. This end is that end at which the person sleeping on the mattress 30 places their head, again assuming that slippage of the mattress 30 is in the direction toward the person's feet.

With this positioning, movement of the mattress 30 in the direction of arrow A relative to the boxspring 32 is substantially prevented because any movement of mattress 30 in the direction of arrow A exerts a force against the second portion 16 of the retainer 12 at the right in FIG. 2 which is applied against the boxspring 32. By resisting the applied force, boxspring 32 thereby prevents movement of the mattress 30 relative to the boxspring 32. It is only possible to move both the mattress 30 and boxspring 32 together, if possible. Prevention of movement of mattress 30 relative to the boxspring 32 precludes slippage of the mattress 30 on the boxspring 32.

Figure 7:
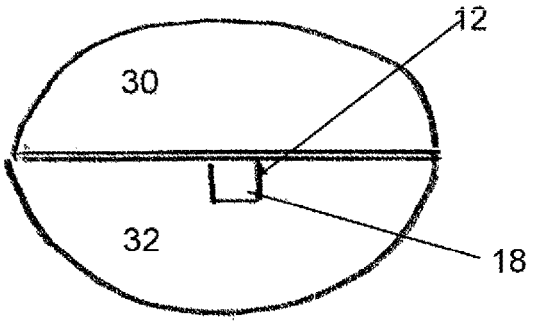
FIG. 7 is a rear view showing the apparatus in accordance with the invention during use.

To install apparatus 10, the boxspring 32 is first placed on its support, if any, for example, a frame. One retainer 12 is then placed at the head of the bed 34 (that side of the bed 34 at which the user will place their head) with its second portion 18 angled downward and the first portion 16 against the upper surface of the boxspring 32 (see the left side of bed 34 in FIG. 2, and FIG. 7). The strap 22 and fixing elements 24 are then adjusted if necessary to position the other retainer 12 close to the foot of the bed 34 (that side of the bed 34 at which the user will place their feet). The strap 22 extends in an axial direction of the bed 34, almost from one longitudinal end of the bed 34 to the other.

Figure 6:
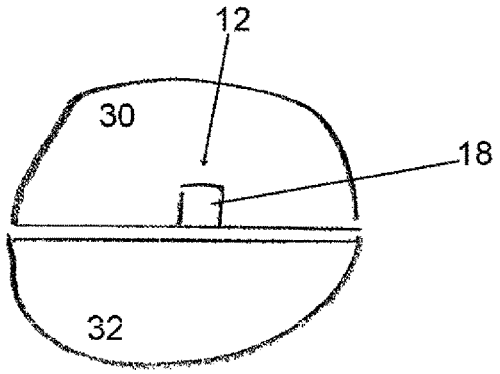
FIG. 6 is a front view showing the apparatus in accordance with the invention during use.

The mattress 30 may then be placed over the boxspring 32 and the strap 22. The retainer 12 at the foot of the bed 34 is positioned to situate the first portion 16 thereof between the mattress 30 and the boxspring 32 and the second portion 18 thereof against the mattress 30 (see the right side of bed 34 in FIG. 2, and FIGS. 3 and 6). Final tightening of the strap 22 and fixing elements 24 may be undertaken. The space between the mattress 30 and the boxspring 32 is exaggerated and in actuality, there will not be any discernible space therebetween.

At this stage, the apparatus is ready for use 10, and will prevent movement of the mattress 30 in the direction of arrow A relative to the boxspring 32 (see FIG. 2).

Since it is possible to incline mattress 30 to raise the head of the bed 34, apparatus 10 will also function particularly well if mattress 30 is inclined. During mattress inclination, the mattress 30 potentially will move in the direction of arrow A (since the left side is raised in FIG. 2), but the presence of apparatus 10 prevents the mattress 30 from slipping off of the boxspring 32.

Apparatus 10 is described above for use to prevent slippage of a mattress 30 relative to a boxspring 32. Apparatus 10 can however be used to prevent slippage of any type of bedding relative to a boxspring 32 as well as to prevent slippage of a mattress 30 relative to any type of underlying support or platform. Even more generally, apparatus keeps two or more (flat or smooth) surfaces from slipping off of, shifting, moving past each other, sliding off each other, etc. Apparatus 10 may be used for almost any stacked objects to prevent slippage of an uppermost object in the stack relative to an immediate underlying lower stacked object. The objects may be boxes or other type of packaging. Thus, although the description of the apparatus 10, as well as another apparatus 40 below, are primarily with respect to bedding, use of the apparatus 10, 40 is not limited to bedding and allows for use with packaging and other boxed material or stacked materials wherein there is an interface between two adjacent objects into which the straight portion 16 may be placed and which objects may potentially move relative to one another.

Indeed, apparatus 10 may be particularly useful for stacked objects in earthquake prone areas. The objects may move during earthquakes and such movement should be prevented. In these situations, the angled portion 18 may be at an obtuse angle relative to the straight portion, i.e., greater than 90 degrees. The obtuse angle allows the upper object to move slightly up the incline of the angled portion 18 during the rumbling of the earthquake, but then settle back to the stacked configuration when the earthquake is over.

As described above for use with a bed 34, the apparatus 10 is positioned with one retainer 12 at the foot of the bed 34 oriented with its second portion 18 upward against the mattress 30 and the other retainer 12 at the head of the bed 34 oriented with its second portion 18 downward. This prevents vertical slippage. It is also possible to use the apparatus 10, or another apparatus 10, to prevent lateral slippage. Lateral slippage arises when the mattress 30 moves to one lateral side relative to the underlying lateral side of the boxspring 32. In this use, one retainer 12 is placed on one lateral side of the bed 34 to which the mattress 34 may move, with the second portion 18 of this retainer 12 oriented upward, and the other retainer 12 is placed on the other lateral side of the bed 34, with the second portion 18 of this retainer 12 oriented downward. Lateral movement of the mattress 30 relative to the boxspring 32 would therefore be presented by this positioning of the apparatus 10.

Two such apparatus could be used, one to prevent longitudinal slippage and the other to prevent lateral slippage, in which case, they would be placed perpendicular to one another. Moreover, it is possible to use multiple apparatus 10 to prevent longitudinal slippage or lateral slippage, i.e., place two or more apparatus 10 alongside one another and substantially parallel to one another in connection with the same bed 34. This might be necessary for wide mattresses.

Figure 8:
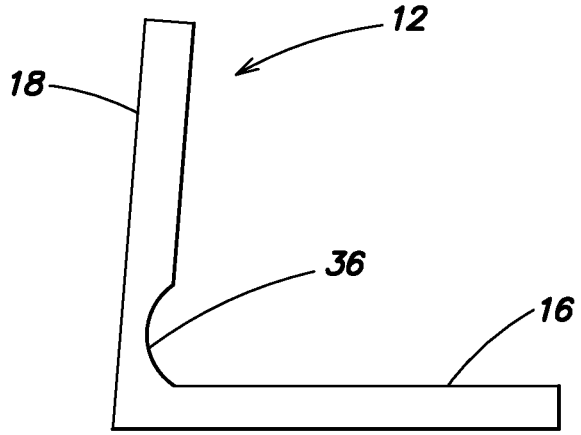
FIG. 8 is an enlarged view showing an optional feature of a corner of the retainer of the apparatus.

FIG. 8 shows an optional feature of the retainer 12, namely a trap 36 to catch a corner of the mattress 30. As shown, the trap 36 is in the form of a recessed or grooved semi-circle but other forms for the trap 36 are also possible and encompassed within the scope of the invention. To this end, trap 36 represents means for engaging with a corner of the mattress 30 and preventing movement of the edge of the mattress 30 upward along the angled portion 18 of the retainer 12. Trap 36 is preferred because the force of a mattress 32 creeping is quite high, and it tends to creep up the angled portion 18 that is supposed to stop the mattress 32. By trapping the corner of the mattress 30, such creep is reduced and ideally prevented.

Figure 9:
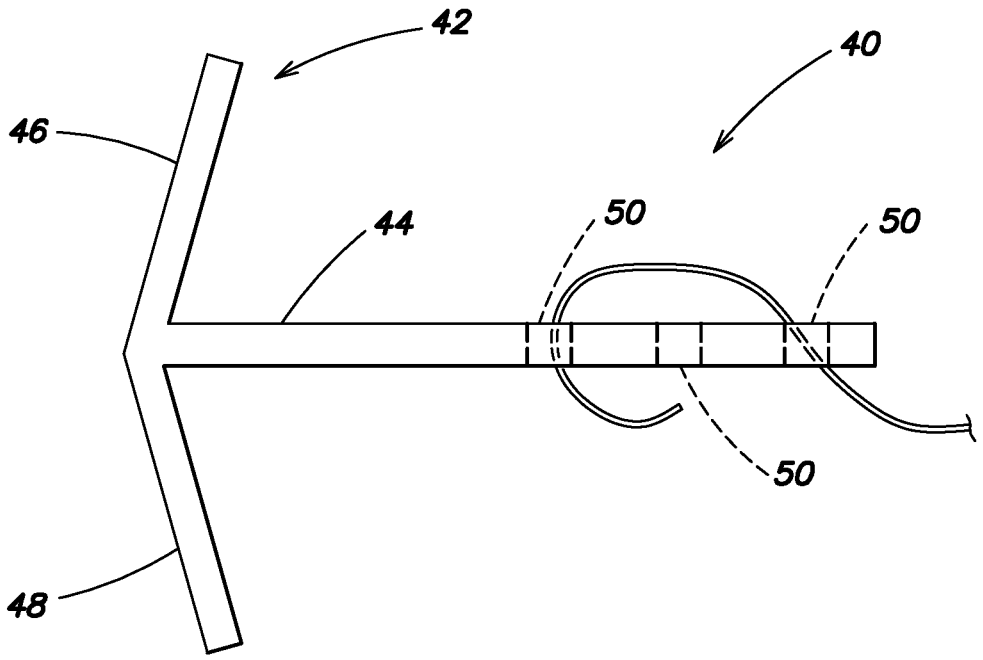
FIG. 9 shows a side view of another embodiment of an apparatus in accordance with the invention.
Figure 12:
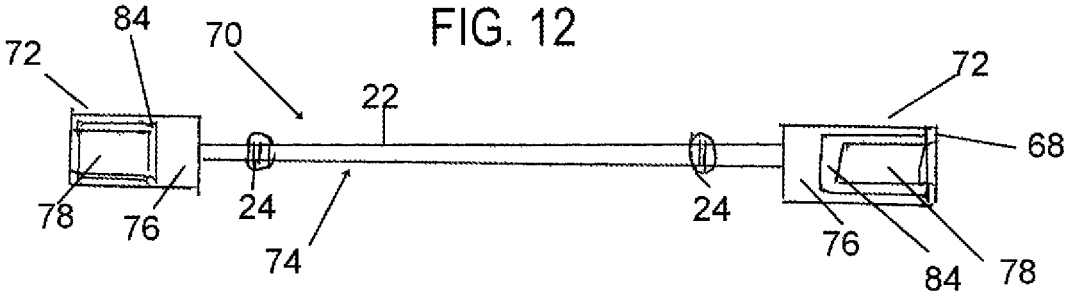
FIG. 12 is a top view of another embodiment of an apparatus in accordance with the invention.
Figure 14:
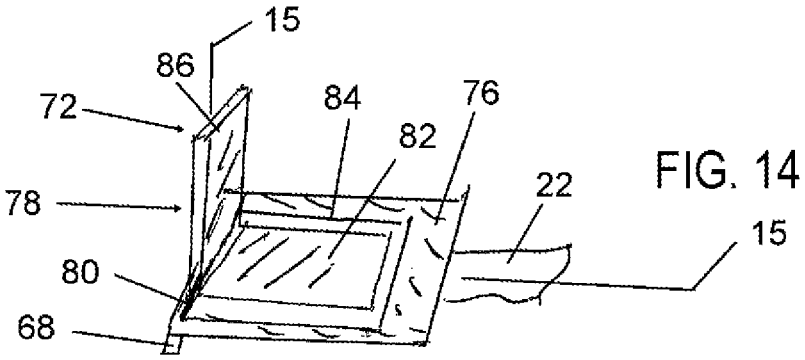
FIG. 14 is a perspective view of a retainer used in the apparatus shown in FIG. 12.
Figure 13:
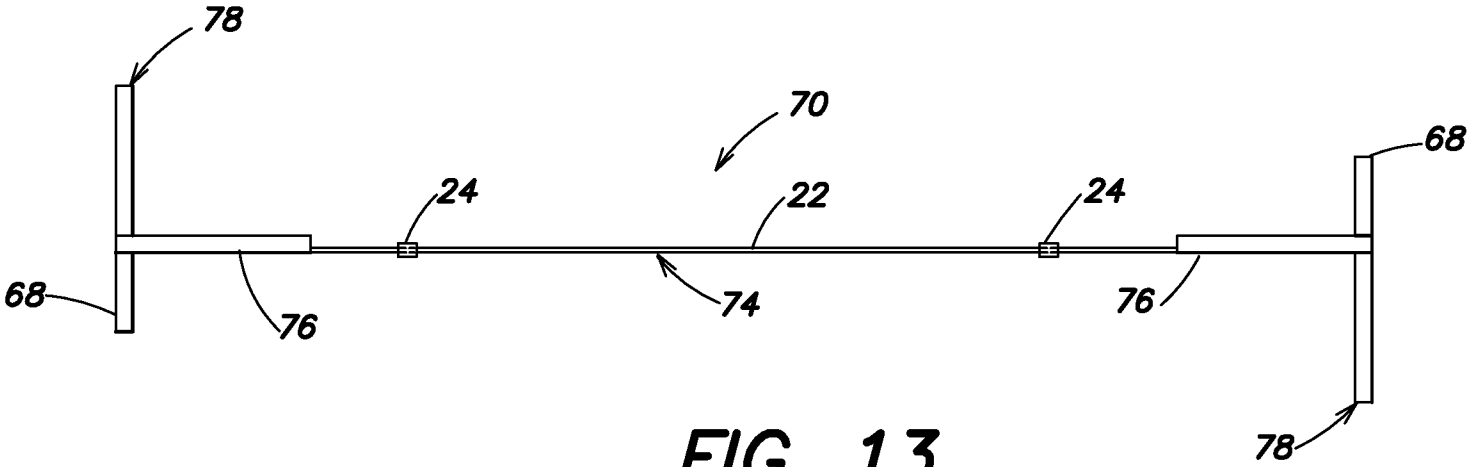
FIG. 13 is a side view of the apparatus shown in FIG. 12.

FIG. 9 shows an embodiment of an apparatus 40 similar to apparatus 10 except that it includes at least one retainer 42 which each have a substantially T-shape or anchor shape, particularly, a straight portion 44 and two angled portions 46, 48, one angled portion 46 oriented upward and the other angled portion 48 oriented downward. The angle between the straight portion 44 and each angled portion 46, 48 is from about 80 degrees to about 115 degrees, preferably from about 85 degrees to about 90 degrees. In one embodiment, the angle between the straight portion 44 and each angled portion 46, 48 is about 90 degrees to enable operative use of the apparatus 40 for the most common situations. Each retainer 42 may be made of plastic, metal or another suitable material.

Apparatus 40 may include a retainer 42 at each end of the same connecting element 14 described above. By using a T-shaped retainer 42 at each end of the connecting element 14, slippage of the mattress in both directions relative to the underlying boxspring is prevented.

Apparatus 40 is positioned with one retainer 42 at the foot of the bed 34 and the other retainer 42 at the head of the bed. This prevents vertical slippage in both directions. It is also possible to use another apparatus 40, or another similar apparatus such as apparatus 10, to prevent lateral slippage. In this use, one retainer 42 of another apparatus 40 is placed on one lateral side of the bed to which the mattress may move, and the other retainer 42 of this apparatus 40 is placed on the other lateral side of the bed. Lateral movement of the mattress relative to the boxspring would therefore be presented by this positioning of the apparatus 40.

Two such apparatus 40 could be used in a perpendicular configuration, one to prevent longitudinal slippage and the other to prevent lateral slippage. Moreover, it is possible to use multiple apparatus 40 to prevent longitudinal slippage or lateral slippage, i.e., place two or more apparatus 40 alongside one another and substantially parallel to one another in connection with the same bed. This might be necessary for wide mattresses.

Features of apparatus 10 could be incorporated into apparatus 40 to the extent practicable. For example, the retainers 42 can each include a trap 36 at the corner of the straight portion 44 and each of the angled portions 46, 48. The structure of the strap 22 and fixing elements 24 may also be the same. The same connecting element 14 may be used in conjunction with slots 50 in the straight portion 44 of the retainer 42 to fix the strap 22 to the retainer 42. In this case, the separate fixing element 24 is not required its function is integrated into the straight portion 44 of the retainer 42, although it could also be separate therefrom as disclosed above. Using three slots 50 allows for threading of the strap 22 in a secure manner (see FIG. 5 above)

Apparatus 10, 40 may be used in a temporary manner when setting up the bed 34 including the mattress 30 and boxspring 32. It can be removed when not needed, or when moving the bed 34. Alternatively, it is possible to fix the apparatus 10, 40 to the bed in a permanent manner. To this end, the retainers 12, 42 could be provided with attachment structure to facilitate a fixed connection to the mattress 30 and boxspring 32. Such permanent attachment structure to securely attach the retainers 12, 42 to the mattress and boxspring 30, 32 are known to those skilled I the art to which this invention pertains. Note that a permanent connection does not mean everlasting and it is meant simply as an attachment that is not easily removable.

Also, the apparatus 10, 40 could be used in a bed that has more than two layers, One or more of the apparatus 10, 40 could be used between each pair of adjacent layers of a multi-layered bed.

Figure 11:
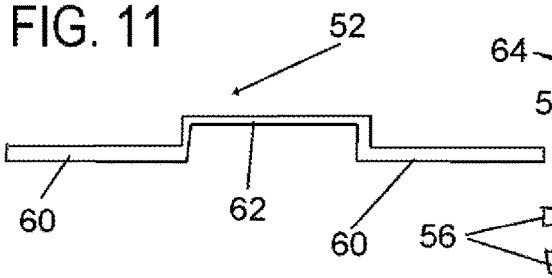
FIG. 11 is a side view of the bracket shown in FIG. 10.
Figure 10:
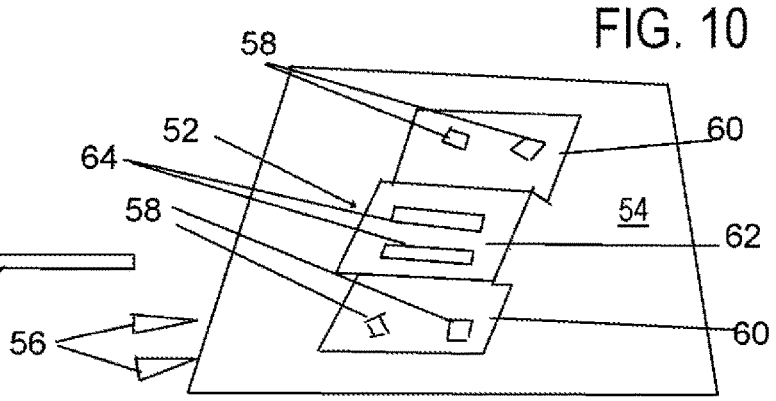
FIG. 10 is a perspective view of a bracket that may be used at one end of the strap of an apparatus in accordance with the invention to fix the apparatus to an external object.

In another embodiment shown in FIGS. 10 and 11, a bracket 52 is provided to attach to a support 54 such as a wall or headboard. Bracket 52 includes any one of a number of conventional bracket attachment means, e.g., screws 56 that pass through holes 58 in side flanges 60 of the bracket 52, that fix the bracket 52 to the support 54.

Bracket 52 is provided with a middle leg portion 62 between the two side flanges 60 and is situated in a different plane than the side flanges 60. The middle portion 62 has a size to enable the angled portion 18 of the retainer 12, and each of the angled portions 46, 48 of the retainer 42 to slide into a space between the middle portion 62 and the support 54 to which the bracket 52 is attached. Each retainer 12, 42 can thus be hooked onto the bracket 52 via the engagement of an angled portion 18, 46, 48 behind the middle portion 62. Bracket 52 is thus used with either of the apparatus 10, 40, in any of their configurations described above, when a support 54 is available.

In an exemplifying, non-limiting use, the retainer 12, 42 at one end of the strap 22 is placed onto the lower object in the stack of objects, e.g., the boxspring 32, and then the mattress 30 is placed onto the boxspring 32 with the retainer 12, 42 in place (or the retainer 12, 42 is simply inserted between the boxspring 32 and mattress 30). The angled portion of the retainer 12, 42 at this end of the strap 22 is oriented upward. The strap 22 is extended from the retainer 12, 42 to the opposite end of the stack of objects. The length of the strap 22 may be adjusted as necessary.

The bracket 52 is positioned on the support 54 and then attached to the support 54 via the side flanges 60 and the selected attachment means (for example, screws 56 through holes 58). As used in this context, the bracket attachment means comprise any structure that is effective to securely attach a bracket to a support, whether an area in a vertical, horizontal or other plane, including structure similar but not limited to the use of holes 58 and screws 56. Alternative bracket attachment means include nails, hook and loop fasteners, magnets, adhesive, epoxy, hooks, staples and the other functionally comparable or equivalent structure.

Once the bracket 52 is attached to the support 54, the retainer 12, 42 at the proximate end of the strap 22 is engaged with the bracket 52 by sliding the angled portion 18 of the retainer 12 or one of the angled portions 46, 48 of the retainer 42 behind the middle portion 62, i.e., between the middle portion 62 and the support 54.

Once the retainer 12, 42 at one end of the strap 22 is attached to the support 54, the upper stacked object is not able to move relative to the lower stacked object because any movement would exert pressure against the angled portion 16, 46, 48 of the retainer 12, 42 at the opposite end of the strap 22, but movement of this retainer 12, 42 is prevented by the secure attachment of the bracket 52 at the other end of the strap 22 to the bracket 52 which in turn is secured to the support 54.

In another embodiment, an apparatus is provided with only a single retainer at one end of the connecting element 14 and the other end of the connecting element is attached directly to the middle portion 62. For example, the middle portion 62 can connect with the strap 22, for example, the strap 22 can slip into and around a part of the middle portion 62, e.g., through slots 64 in the middle portion 62 (see FIG. 10). In this exemplifying, non-limiting use, the strap 22 is connected to the bracket 52 via slots 64 in its middle portion 62. The retainer 12, 42 at other end of the strap 22 is placed onto the lower object in the stack of objects, e.g., the boxspring 32, and then the mattress 30 is placed onto the boxspring 32 with the retainer 12, 42 in place (or the retainer 12, 42 is simply inserted between the boxspring 32 and mattress 30). The angled portion of the retainer 12, 42 is oriented upward. The strap 22 is extended from the retainer 12, 42 to the opposite end of the stack of objects. The length of the strap 22 may be adjusted as necessary.

Once the strap 22 is connected to the bracket 52 which in turn is attached to the support 54, the upper stacked object is not able to move relative to the lower stacked object because any movement would exert pressure against the angled portion 16, 46, 48 of the retainer 12, 42, but movement of this retainer 12, 42 is prevented by the secure attachment of the strap 22 to the bracket 52 which in turn is secured to the support 54.

Referring now to FIGS. 12-16, another apparatus in accordance with the invention is designated 70 and includes two retainers 72 at each end of a connecting element 74. Connecting element 74 may be like connecting element 14 described above and include a strap 22 and fixing elements 24 at each end of the strap 22.

Each retainer 72 includes a base 76 and a pivot member 78 pivotally mounted by one or more pins 80 to the base 76. Pivot member 78 includes a first straight portion 82 that when in use, lies in generally the same plane as the base 76 (in an opening 84 defined by the base 76) and a second angled portion 86 at an angle of between about 80 and about 115 degrees to the first portion 82 (the use state of one retainer being shown in FIGS. 13-15). Angled portion 86 is considered the angled portion of the retainer 72. Portions 82, 86 function like portions 16, 18 of retainer 12 described above in order to prevent slippage of an upper stacked object relative to an underlying, lower stacked object (the use state of the apparatus 70 being shown in FIG. 13). The retainer 72 at the opposite end of the connecting element 74 has its angled portion 86 extending downward when in the use state of the apparatus 70 (see FIG. 13).

Figure 15:
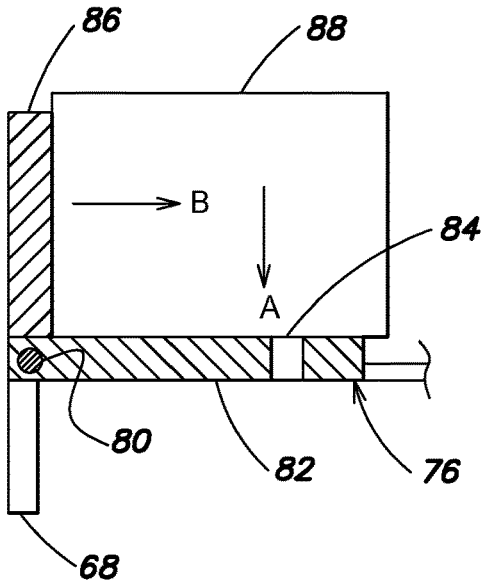
FIG. 15 is a cross-sectional view taken along the line 15-15 in FIG. 14.
Figure 16:
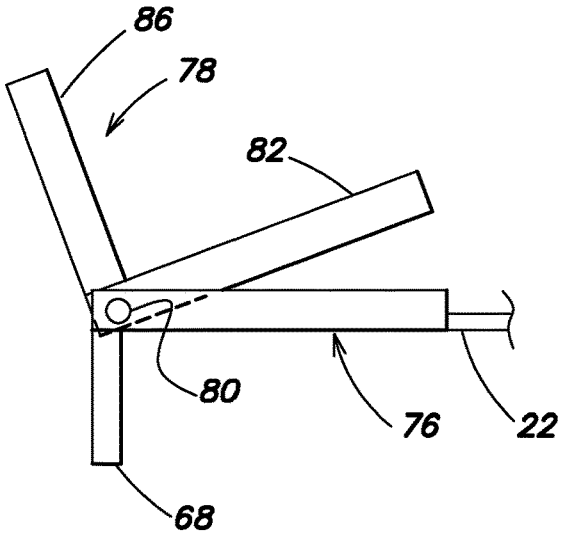
FIG. 16 is a side view of the retainer shown in FIG. 14 when in a non-use state.

However, in this embodiment, by virtue of the presence of the pin(s) 80, the pivot member 78 is able to pivot relative to the base 76 so that weight of the upper stacked object 88 (effective in the direction of arrow A in FIG. 15) causes the pivot member 78 to attempt to turn about the axis defined by the pivot pin(s) 80 and exert pressure against the upper stacked object 88 (in the direction of arrow B in FIG. 15). Thus, when using retainer 72, additional force is provided by weight of the upper stacked object 88 to keep the retainer 72 in place and generate a force preventing slippage of the upper stacked object 88 relative to the underlying lower stacked object.

Another advantage is that when placing the upper stacked object 88 onto the retainer 72, the retainer self-positions. That is, if it is in the position shown in FIG. 16, the placement of the upper stacked object 88 causes the retainer 72 to pivot to the position shown in FIG. 15.

An optional feature of retainers 72 is a positioning plate 68 that extends from the base 76 in an opposite direction to which the angled portion 86 extends. The positioning plate 68, which represents any rigid member, element or component, serves to aid in guiding the retainer 72 into a position between the adjacent stacked objects.

With the positioning plate 68, each retainer 72 could function like retainer 40 described above. If two retainers 72 are provided, then the retainer at one end of the objects could be oriented with the angled portion 86 of the pivot member 76 upward, and the positioning plate 68 downward, and the retainer 72 at the other end could be in the same or a reversed orientation. Indeed, the retainers 72 with positioning plates 68 could be used in any orientation at the ends of the connecting element 74 since each provides a surface against which pressure is exerted by the upper stacked object and which is in contact with the lower stacked object at the opposite end of the apparatus to prevent slippage of the upper stacked object relative to the lower stacked object.

In another construction of retainer 72, it is possible to provide two pivot members on each retainer pivotally attached to the same base. One pivot member is configured to pivot such that its angled portion extends above the base (when its straight portion is close to or in the same plane as the base) and the other is configured to pivot such that its angled position extends below the base (when its straight portion is close to or in the same plane as the base). The pivot members may be situated one above the other, or side by side and attached via a common pivot pin or pins or different pivots, or the pivot members may be nested within one another. By having two pivot members, one for the top stacked object and the other for the bottom stacked object, such an apparatus provides the stacker with an easier ability to securely stack the objects.

Figure 17:
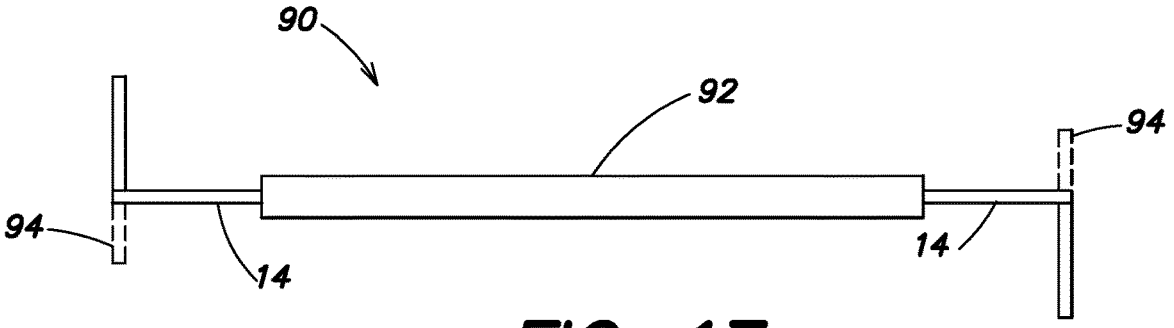
FIG. 17 is a side view of another embodiment of an apparatus in accordance with the invention.

Finally, FIG. 17 shows an apparatus 90 like apparatus 10 but with an elongate rigid bar 92 connecting the retainers 14. The bar 92 is fixed to the retainers 14. Any of the apparatus disclosed herein could use a rigid bar 92 instead of the strap 22, and the fixing elements 24 and other structure needed for adjustment of the length of the connecting element would be superfluous. The bar 92 has only a single length, but different size bars could be provided. Retainers 14 each include an optional positioning plate 94, like positioning plate 68 of retainer 72.

The bar 92 could also be adjustable to different lengths, possible including a telescoping configuration of elongate members to enable such length adjustment, A locking mechanism may be provided when an adjustable length bar is provided to lock the bar 92 at a desired length. An elongate bar, as used herein, therefore represents any type of rigid structure made up of one or more parts that can be configured to provide a desired length in a stable state, and which is connected at each end of the structure to the retainers 14, or alternatively, to any of the other retainers disclosed herein, e.g., retainer 72.

Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention which is limited only by the following claims.

The invention claimed is:

1. A slippage prevention apparatus for preventing slippage of an upper stacked object relative to an immediately underlying lower stacked object, comprising:

a first rigid retainer consisting of:

a first, straight portion having a planar portion having an upper surface, a lower surface and an edge along one side of said planar portion; and a second, angled portion extending only from the edge along one side of said planar portion of said first straight portion such that said angled portion is connected to said first straight portion only at the edge along one side of said planar portion of said first straight portion, said second angled portion being at an angle of about 80 degrees to about 115 degrees to said first straight portion and which is oriented downward relative to said first straight portion;

a second rigid retainer consisting of:

a first, straight portion having a planar portion having an upper surface, a lower surface and an edge along one side of said planar portion; and a second, angled portion extending only from the edge along one side of said planar portion of said first straight portion of said second retainer such that said angled portion of said second retainer is connected to said first straight portion of said second retainer only at the edge along one side of said planar portion of said first straight portion of said second retainer, said second angled portion of said second retainer being at an angle of about 80 degrees to about 115 degrees to said first straight portion of said second retainer and which is oriented upward relative to said first straight portion of said second retainer; and a connecting element connected at one end region to said first retainer and at an opposite end region to said second retainer.

2. The apparatus of claim 1, wherein the edge along one side of said planar portion of said first straight portion of said first retainer is straight.

3. The apparatus of claim 2, further comprising:

a bracket attachable to a support and including side flanges and a middle portion in a different plane than said side flanges; and bracket attachment means for attaching said side flanges of said bracket to the support, said second angled portion of said second retainer being configured to slide behind said middle portion of said bracket to secure said second retainer to said bracket and thus to the support when said bracket is attached to the support by said bracket attachment means.

4. The apparatus of claim 1, wherein said connecting element comprises a strap and a pair of fixing elements, one at each end region of said strap, said fixing elements being adjustable relative to said strap to provide said strap with an adjustable length.

5. The apparatus of claim 4, wherein said fixing elements each have two slots sized to allow said strap to pass therethrough, each end region of said strap being looped through said two slots in a respective one of said fixing elements to form a loop into which a portion of said planar portion of said first straight portion of a respective one of said first and second retainers is situated.

6. The apparatus of claim 1, wherein said connecting element comprises an elongate strap, a first component at one end region of said strap that is connected to said first retainer and a second component at an opposite end region of said strap that is connected to said second retainer.

7. The apparatus of claim 1, further comprising attachment means for connecting said connecting element to each of said first and second retainers.

8. The apparatus of claim 1, wherein said second angled portion of said first retainer comprises a recessed semi-circular surface extending from a surface of said second angled portion of said first retainer forming the angle of about 80 degrees to about 115 degrees with said first straight portion of said first retainer, said semi-circular surface forming a recessed semi-circle in said second angled portion of said first retainer for receiving a corner of the upper stacked object along one side of the upper stacked object.

9. The apparatus of claim 1, wherein said connecting element comprises an elongate bar attached at one end to said first retainer and at an opposite end to said second retainer.

10. The apparatus of claim 9, wherein said bar is adjustable.

11. The apparatus of claim 1, wherein said first retainer includes a base and a pivot member pivotally mounted to said base, said pivot member including a first straight portion and a second angled portion that constitutes said second angled portion of said first retainer, said pivot member pivoting relative to said base such that when said first straight portion of said pivot member is in a common plane with said base, said second angled portion of said pivot member extends upward.

12. The apparatus of claim 11, wherein said first retainer further comprises a positioning plate extends from said base in a downward direction.

13. The apparatus of claim 11, wherein said second retainer includes a base and a pivot member pivotally mounted to said base, said pivot member of said second retainer including a first, straight portion and a second, angled portion that constitutes said second angled portion of said second retainer.

14. A method for preventing slippage of an upper stacked object relative to an immediately underlying lower stacked object, comprising:

placing a first rigid retainer consisting of a first, straight portion having a planar portion having an upper surface, a lower surface and an edge along one side and a second, angled portion extending only from the edge along one side of the planar portion of the first straight portion at one end of the upper stacked object such that the first straight portion is between the upper stacked object and the lower stacked object and the second angled portion is oriented upward and an edge of the upper stacked object rests against the angled portion, the second angled portion being at an angle of about 80 degrees to about 115 degrees to the first straight portion and being connected to the first straight portion only at the edge along one side of the planar portion of the first straight portion;

placing a second rigid retainer having a first, straight portion and a second, angled portion at an angle of about 80 degrees to about 115 degrees to the first straight portion of the second retainer at an opposite end of the upper stacked object such that the first straight portion of the second retainer is between the upper stacked object and the lower stacked object and the second angled portion of the second retainer is oriented downward and an edge of the lower stacked object rests against the second angled portion of the second retainer; and connecting the first and second retainers together such that force exerted by the upper stacked object against the second angled portion of the first retainer is exerted against the lower stacked object by the second angled portion of the second retainer and thereby movement of the upper stacked object in a direction toward the second angled portion of the first retainer is prevented.

15. The method of claim 14, wherein the edge along one side of the planar portion of the first straight portion of the first retainer is straight and the step of connecting the first and second retainers together comprises attaching the first straight portion of each of the first and second retainers to a respective end region of an elongate strap.

16. The method of claim 15, wherein a fixing element is attached to each end region of the strap and which are adjustable relative to the strap, and the step of connecting the first and second retainers together further comprises adjusting at least one of the fixing elements until there is tension in the strap to thereby provide a tight connection of the first and second retainers to one another.

17. A method for preventing slippage of an upper stacked object relative to an immediately underlying lower stacked object, comprising:

placing a first apparatus longitudinally between the upper stacked object and the lower stacked object, the first apparatus including:

a first rigid retainer consisting of a first, straight portion having a planar portion having an upper surface, a lower surface and an edge along one side and a second angled portion extending only from the edge along one side of the planar portion of the first straight portion at an angle of about 80 degrees to about 115 degrees to the first straight portion, a second rigid retainer consisting of a first, straight portion having a planar portion having an upper surface, a lower surface and an edge along one side and a second, angled portion extending only from the edge along one side of the planar portion of the first straight portion of the second retainer at an angle of about 80 degrees to about 115 degrees to the first straight portion of the second retainer, and an adjustable connecting element connected at one end region to the first retainer and at an opposite end region to the second retainer, the second angled portion of the first retainer being connected to the first straight portion of the first retainer only at the edge along one side of the planar portion of the first straight portion of the first retainer and the second angled portion of the second retainer being connected to the first straight portion of the second retainer only at the edge along one side of the planar portion of the first straight portion of the second retainer, the step of placing the first apparatus longitudinally between the upper stacked object and the lower stacked object comprising:

placing the first retainer at one end of the upper stacked object such that the first straight portion of the first retainer is between the upper stacked object and the lower stacked object and the second angled portion of the first retainer is oriented upward and an edge of the upper stacked object rests against the second angled portion of the first retainer;

placing the second retainer at an opposite end of the upper stacked object such that the first straight portion of the second retainer is between the upper stacked object and the lower stacked object and the second angled portion of the second retainer is oriented downward and an edge of the lower stacked object rests against the second angled portion of the second retainer; and adjusting the connecting element such that force exerted by the upper stacked object against the second angled portion of the first retainer is exerted against the lower stacked object by the second angled portion of the second retainer and thereby movement of the upper stacked object in a direction toward the second angled portion of the first retainer is prevented.

18. The method of claim 17, wherein the edge along one side of the planar portion of the first straight portion of the first retainer is straight and the connecting element comprises an elongate strap and a fixing element is attached to each end region of the strap and which are adjustable in position relative to the strap, each of the first and second retainers being attached to a respective end region of the strap, the step of adjusting the connecting element comprising adjusting at least one of the fixing elements until there is tension in the strap to thereby provide the tight connection of the first and second retainers.

19. The method of claim 17, further comprising:

placing a second apparatus transversely between the upper stacked object and the lower stacked object in a direction perpendicular to the orientation of the first apparatus, the second apparatus including:

a first rigid retainer consisting of a first, straight portion having a planar portion having an upper surface, a lower surface and an edge along one side and a second, angled portion extending only from the edge along one side of the planar portion of the first straight portion at an angle of about 80 degrees to about 115 degrees to the first straight portion of the first retainer of the second apparatus, a second rigid retainer consisting of a first, straight portion having a planar portion having an upper surface, a lower surface and an edge along one side and a second, angled portion extending only from the edge along one side of the planar portion of the first straight portion at an angle of about 80 degrees to about 115 degrees to the first straight portion of the second retainer of the second apparatus, and an adjustable connecting element connected at one end region to the first retainer of the second apparatus and at an opposite end region to the second retainer of the second apparatus, the second angled portion of the first retainer of the second apparatus being connected to the first straight portion of the first retainer of the second apparatus only at the edge along one side of the planar portion of the first straight portion of the first retainer of the second apparatus and the second angled portion of the second retainer of the second apparatus being connected to the first straight portion of the second retainer of the second apparatus only at the edge along one side of the planar portion of the first straight portion of the second retainer of the second apparatus, the step of placing the second apparatus transversely between the upper stacked object and the lower stacked object comprising:

placing the first retainer of the second apparatus at one lateral side of the upper stacked object such that the first straight portion of the first retainer of the second apparatus is between the upper stacked object and the lower stacked object and the second angled portion of the first retainer of the second apparatus is oriented upward and a lateral edge of the upper stacked object rests against the second angled portion of the first retainer of the second apparatus;

placing the second retainer of the second apparatus at an opposite lateral side of the upper stacked object such that the first straight portion of the second retainer of the second apparatus is between the upper stacked object and the lower stacked object and the second angled portion of the second retainer of the second apparatus is oriented downward and a lateral edge of the lower stacked object rests against the second angled portion of the second retainer of the second apparatus; and adjusting the connecting element such that force exerted by the upper stacked object against the second angled portion of the first retainer of the second apparatus is exerted against the lower stacked object by the second angled portion of the second retainer of the second apparatus and thereby movement of the upper stacked object in a direction toward the second angled portion of the first retainer of the second apparatus is prevented.

* * * * *